United States Patent [19]

Theodore et al.

[11] 3,970,547

[45] July 20, 1976

[54] AIR CLASSIFICATION APPARATUS

[75] Inventors: Michael J. Theodore, Weston, Mass.; Malcolm M. Paterson, Atkinson, N.H.; Vernon L. Schrimper, Cedar Rapids, Iowa

[73] Assignee: Raytheon Company, Lexington, Mass.

[22] Filed: May 22, 1975

[21] Appl. No.: 580,374

[52] U.S. Cl. ..... 209/136; 209/147; 209/152; 302/50

[51] Int. Cl.[2] ..... B07B 4/06

[58] Field of Search ..... 302/50; 209/134–139 R, 209/140, 141, 147, 152, 284, 288, 294, 297, 298, 257, 473, 482, 221, 224

[56] References Cited

UNITED STATES PATENTS

| | | | |
|---|---|---|---|
| 1,186,874 | 6/1916 | Baer | 209/152 |
| 1,258,911 | 3/1918 | Kinyon | 302/50 X |
| 1,350,419 | 8/1920 | Morrison | 302/50 X |
| 1,981,318 | 11/1934 | James | 209/152 X |
| 3,004,799 | 10/1961 | Tikal | 302/50 |
| 3,232,297 | 2/1966 | Gamberini | 209/134 X |
| 3,508,646 | 4/1970 | Conrad et al. | 209/45 X |
| 3,804,249 | 4/1974 | Gibbons et al. | 209/482 X |

*Primary Examiner*—Frank W. Lutter
*Assistant Examiner*—Ralph J. Hill
*Attorney, Agent, or Firm*—Harold A. Murphy; Joseph D. Pannone; John T. Meaney

[57] ABSTRACT

A rotary drum air classifier system which includes a side feed hopper by which mixed materials to be separated are fed to a screw feed which deposits the materials inside the drum for major separation into light and heavy materials, the screw feed being longitudinally adjustable and including air injection means for fluidizing the mixed materials as they are being transported to the drum and thus accomplishing a preliminary stage of air classification during the time the mixed materials are transiting the length of the feed screw.

12 Claims, 6 Drawing Figures

AIR CLASSIFICATION APPARATUS

BACKGROUND OF THE INVENTION

In known air classification systems for receiving mixed materials and separating them into respective groups of light and heavy materials there is employed a rotary drum air classifier. The drum is disposed at an angle to the horizontal and air is forced at high velocity through it, in at the lower end and out the higher end. Mixed materials are supplied by a belt conveyor to a midpoint along the length of the drum interior where they fall from the conveyor onto the drum wall. As the drum rotates about its axis, longitudinally extending lifters on the drum wall carry the materials upwardly to a point where they again fall by gravity onto the drum wall; this time, however, because of the drum's angle they fall at a point nearer the lower end of the drum.

During such dropping of the mixed materials from the end of the conveyor and from the lifters the high velocity air stream will entrain within it light materials such as paper and the like and will carry such light materials out the upper end of the drum to be collected for further processing or disposal.

The heavy materials, however, will be repetitively raised and dropped inside the drum as it rotates until eventually they will fall out the lower end of the drum for subsequent further processing or disposal.

However, it has been found that unenclosed or canopied belt conveyors are somewhat unsuitable for feeding mixed materials into the drum from a supply hopper since the conveyors usually are located in such a position that they will intercept some of the heavy materials as they fall after being raised by the lifters or vanes during the separation procedure. Furthermore, in municipal waste there are often included substantial amounts of wire. It has been found that when unenclosed belt conveyors are used it is very easy for pieces of wire to become entangled in the mechanism. It will be apparent that this can seriously interfere with the operation of the device.

With prior art rotary drum air classifiers it has been believed necessary to deposit the mixed materials within the drum at a point which is centrally disposed along the longitudinal dimension or length of the drum. However, it has been found that this requirement is not necessary and in fact can unnecessarily extend the operative time for efficient classification.

An additional objection to prior art rotary drum air classification systems is the fact that the feed conveyor is of fixed length and continuously deposits mixed materials at a single location in the drum regardless of the conveyor's varying loads, thus sometimes causing clogging of the drum and requiring that steps be taken to shut down the conveyor and unclogging the drum before additional materials can be processed.

SUMMARY OF THE INVENTION

The above and other objections to and disadvantages of known rotary drum air classifier systems are overcome and improved upon by the present invention wherein there is employed a screw feed mechanism for feeding mixed materials from a supply hopper into an end portion of a rotary drum. In accordance with this invention, not only is efficient and fast separation of light and heavy materials achieved by depositing the materials within a distance of about a third the length of the drum, but the screw feed mechanism is axially adjustable in an efficient manner so that the actual point at which materials are deposited may be varied or changed. This aids immensley in the prevention of clogging within the drum. Furthermore, such adjustment of the feed screw permits a selected lights-to-heavies classification ratio to be optimized.

The invention contemplates the use of a screw feed which is encased within a cylindrical housing and thus the materials falling onto the top of the casing as the drum rotates will not be intercepted but will only be deflected as they fall to the bottom of the drum.

The screw feed mechanism is itself fed by a side entry feed hopper which aids in the prevention of clogging within the screw feed mechanism. Further, the screw itself is provided with means for fluidizing the mixed materials as they are being transported to the drum. This is achieved by providing the screw with a hollow shaft within which is positioned an inner tubing which is connected to a source of air under relatively high pressure. The tubing and the screw shaft are both apertured and thus air can be injected into the mixed materials as they are being urged by the screw toward the drum. Since heavy materials will naturally tend to remain near the lowermost portions of the screw, such air injections will tend to separate the light materials and move them toward the uppermost portions of the screw. In this way a preliminary stage of air classification is achieved in the materials while they are transiting the length of the feed screw.

BRIEF DESCRIPTION OF THE DRAWINGS

The above and other objectives and advantages of this invention will become apparent from the following description taken in connection with the accompanying drawings, wherein.

DESCRIPTION OF THE PREFERRED EMBODIMENT

Figure 2:
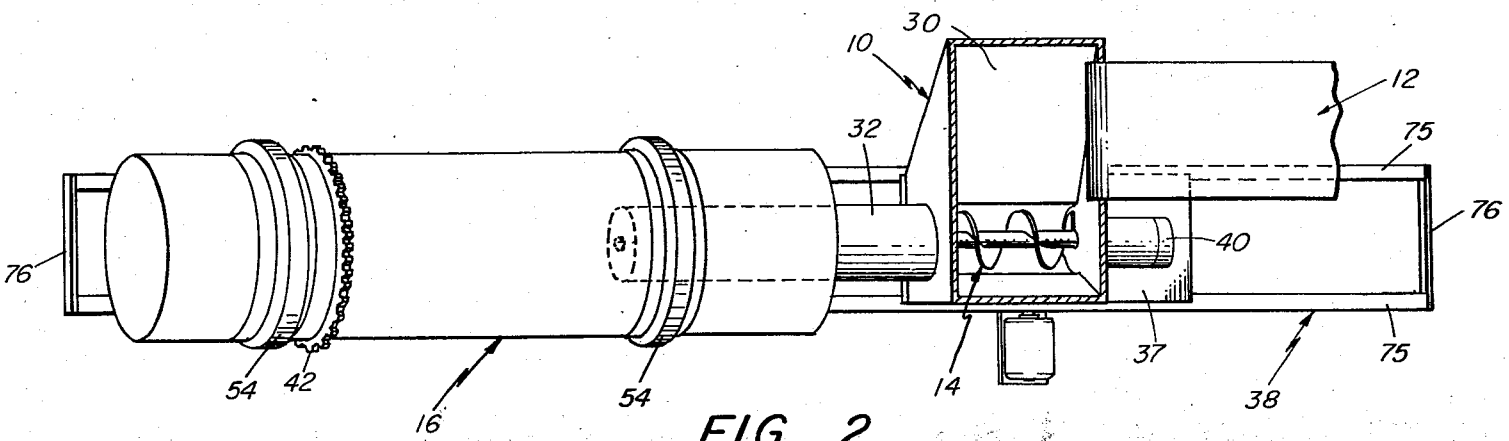
FIG. 2 is a top plan view of the apparatus shown in FIG. 1.
Figure 1:
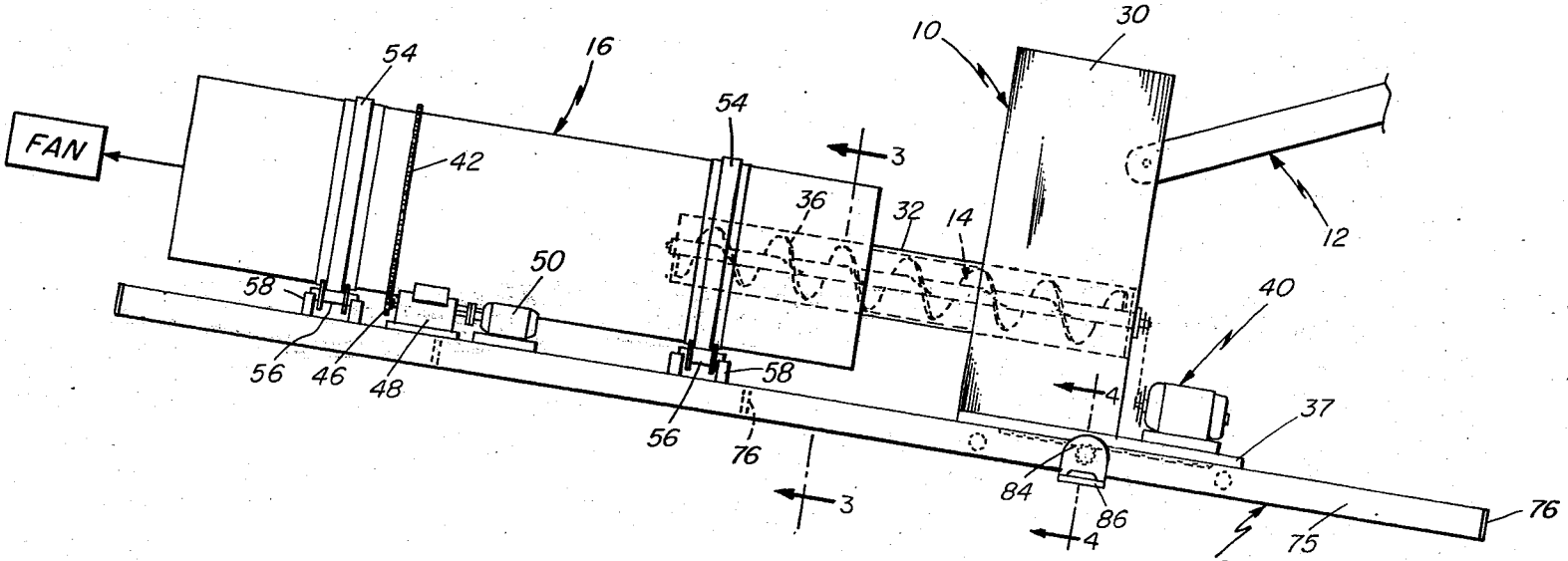
FIG. 1 is a front elevational view of air classifier apparatus embodying the invention.

Referring more particularly to the drawings wherein like characters of reference designate like parts throughout the several views, the apparatus shown in FIG. 1 includes a number of cooperating devices arranged to process and separate materials automatically in sequential fashion, these pieces of apparatus being parts of a complete resource separating and recovery system.

A feed hopper 10 receives shredded raw material from an adjacent conveyor 12 and directs it to a screw feed 14 which deposits it within a rotatable air drum classifier 16. The drum classifier separates the raw materials into light and heavy materials in the known fashion of devices of this character. The drum is angled at a selected inclination, such as 10° for example, and air is caused to flow through it at high velocity by means of a fan, for instance, as shown in FIG. 1. As raw materials drop from the end of the screw feed onto the bottom of the drum wall, the heavy materials will be rotated upwardly with the drum to a point where they will fall to a lower point within the drum. This action is repeated until eventually the heavy materials fall out of the lower end of the drum onto a conveyor (not shown) which will carry them away for further processing or disposal.

The light materials will be entrained within the high velocity air stream and will be carried out the upper end of the drum 16 for further processing.

The feed hopper 10 is provided with a bucket portion 30 at its upper end into which the raw materials are deposited by the conveyor 12. These raw materials have previously been shredded so that they comprise a mixture of raw material elements not exceeding about twelve inches in size, for example.

A feed duct or conduit 32 extends from the base 34 of the feed hopper 10 into the adjacent end of the drum 16. Within the duct 32 is a screw 36, one end of which is mounted in the hopper base 34 to receive the raw materials from bucket 30. Hopper 10 is mounted upon a suitable base 37 which is in turn disposed upon a platform 38 which also supports the drum 16, as will be described. The hopper 10 is of a type known as a side feed hopper which has been found to be particularly efficient.

Screw 36 is driven by a motor and chain drive 40 so that the raw materials will be moved along duct 32 into the drum interior. The duct is preferably designed and located so that the raw materials will fall from the end of the screw onto the drum wall preferably at a point within the first third of the length of the drum.

At a point midway of its length the drum is provided with a fixed circumferential sprocket wheel 42 which meshes with a chain link drive belt carried by a pair of smaller sprocket wheels 46. One sprocket wheel 46 is rotatably mounted on one end of a reduction gear box 48 which is interconnected with drive motor 50 on platform 38 whereby rotation of the drum is accomplished. The second small sprocket wheel is supported in any suitable manner as by a supporting bracket on the platform.

The platform 38 and consequently the drum 16 thereon is angled to a selected inclination, such as 10° for example. To prevent longitudinal displacement of the drum there are provided two fixed restraining rings or collars 54 extending around the circumference of the drum and spaced from respective ends thereof. Each ring 54 engages a respective roller 56 mounted by suitable bearings in a support 58 carried by the platform 38. Flanges on the sides of the rollers 56 prevent longitudinal movement of the drum as it is rotated.

Air at high velocity is forced through the drum 16 by means of fans or blowers (not shown) positioned to draw air into the lower end of the drum and out the upper end.

In the construction and operation of an air drum classifier of this sort, there are provided a series of spaced longitudinally extending ribs or vanes 72 (FIG. 3) on the inner wall of the drum 16 which function as lifters to raise the heavy materials, as the drum rotates, to a height from which they may be dropped again to the bottom of the drum. It will be understood that since the drum is inclined the heavy materials will be dropped nearer the lower end of the drum. Therefore, continued rotation of the drum and lifting and dropping of the heavy materials will move the materials toward the lower end of the drum until they eventually fall out of the drum onto a conveyor. A considerable amount of the light materials emanating from the adjacent end portion of the feed duct 32 will be entrained in the high velocity air stream as the raw materials drop from the duct onto the drum wall and will be drawn out the upper end of the drum.

However, some small amounts of light materials will be mixed with the heavy materials falling onto the drum wall. These light materials will, of course, also be raised by the lifters and will eventually be removed by the air stream during the repetitive drops as the drum is rotated. Consequently substantially all of the light materials will eventually be separated and drawn out of the drum.

The ratio of lights-to-heavies may be somewhat controlled by varying the angle of inclination of the drum and thus varying the velocity of the air passing through the drum. The drum angle may be easily accomplished by any well known means.

It has been found that optimization of the lights-to-heavies classification ratio can be further aided by congrol of the actual point within the drum at which the mixed materials are deposited. For example, if the materials are deposited near the entrance end of the drum, the separating process will be less efficient since more light materials may be retained with the heavy materials. Conversely, more light materials will be separated as the point of deposit progresses inwardly of the drum. It has been found that with a deposit point about one-third the way within the drum, optimum separation can be achieved with a drum about 36 feet in length and about 9 feet in diameter, for example.

Such control or change in the point of deposit is achieved in accordance with this invention by providing means for selectively translating the screw feed 14 along the longitudinal axis of the drum 16.

Figure 3:
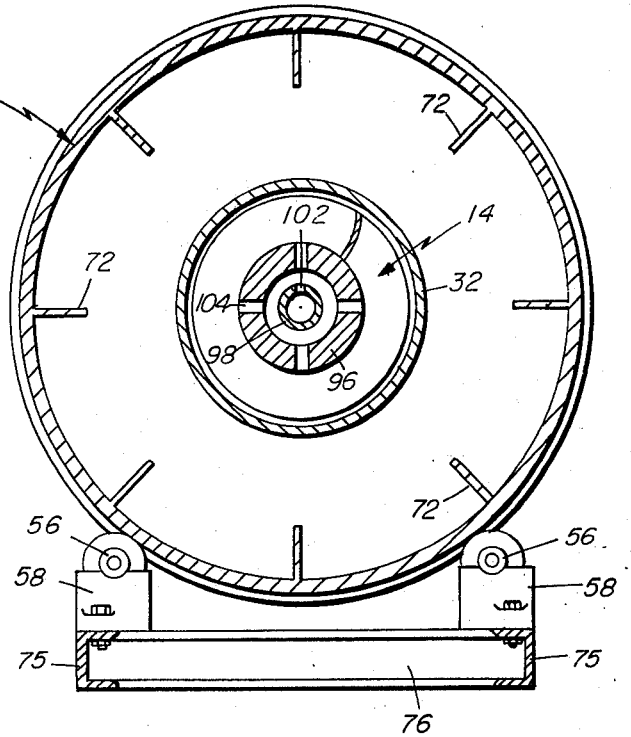
FIG. 3 is an enlarged vertical sectional view taken substantially on line 3—3 of FIG. 1 looking in the direction of the arrows.
Figure 4:
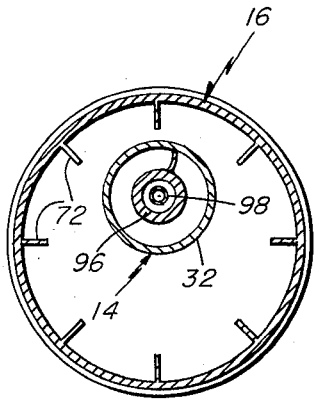
FIG. 4 is a schematic illustration on a reduced scale of a rotary drum with an off-axis screw feed device.

Although the screw feed device 14 is shown in FIG. 3 as being substantially axially aligned with the drum 16, some increase in classification efficiency may be achieved by raising the screw feed device 14 above the axis of the drum as schematically illustrated in FIG. 4. Thus, the materials falling out of the end of the screw feed device will fall a greater distance and, therefore, will be more greatly affected by the high velocity air stream passing through the drum. The possibility of clogging beneath the end of the device 14 is also greatly reduced.

The platform 38 may be constructed in any desired manner so as to support the drum 16 and the hopper 10. It may be a solid platform or it may comprise, as shown in the drawings, a pair of spaced longitudinally extending beams 75 interconnected at intervals by cross members 76. The hopper base 37 is mounted in spanning relation upon the beams 75 which are conveniently shaped as channels having their respective spaced parallel sides directed inwardly toward each other.

Figure 5:
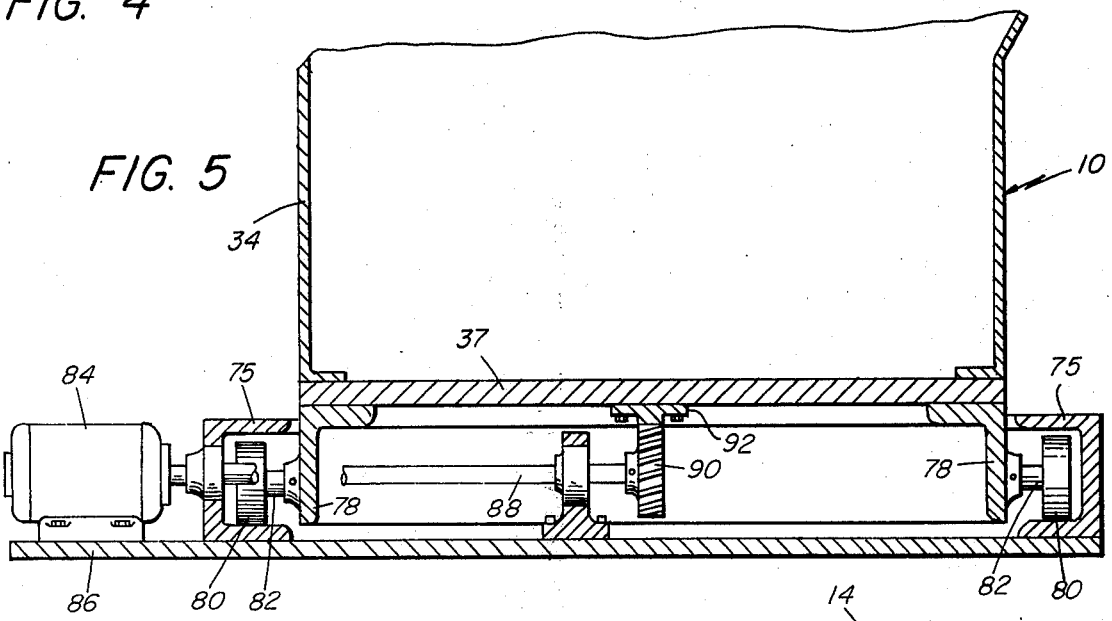
FIG. 5 is an enlarged vertical sectional view taken substantially on line 4—4 of FIG. 1 looking in the direction of the arrows.

As shown best in FIG. 5, two spaced longitudinally extending angle irons 78 are fixed to the bottom of base 37 and depend downwardly between and adjacent to the channels 75, and wheels 80 rotatably mounted by respective shafts 82 on the angle irons 78 are positioned within the channels 75 and ride upon the lower sides of the channels, as shown. Thus, the base 37 and hopper 10 thereon, as well as the screw feed 14 which is supported by the hopper, are all adapted to move as a unit toward and away from the drum 16.

Any suitable electrical or mechanical means may be employed to effect such movement, and in FIG. 5 such means is depicted as a motor 84 which is mounted on a ledge 86 secured to the under side of the platform 38. The motor is connected by a drive shaft 88 to a drive gear 90 which engages a toothed rack 92 fixed to the bottom of base 37. Thus, by operation of the motor 84 and resultant operation of drive shaft 88, gear 90 and rack 92 the base 37, hopper 10 and feed screw 14 may be moved along the platform. Thus, the feed screw may be selectively positioned within the drum to deposit materials at a selected location therein.

Such adjustment not only controls the lights-to-heavies ratio but also prevents balling of materials within the drum.

Figure 6:
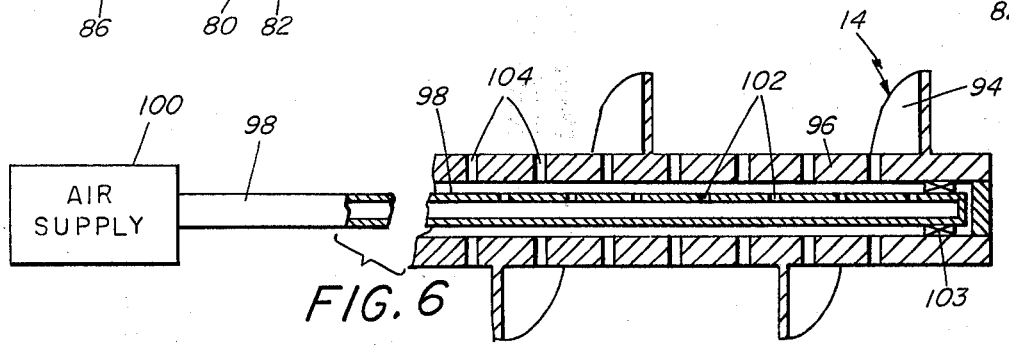
FIG. 6 is an enlarged view partly in section through the screw feed and air supply pipe.

A further improvement achieved with the present invention is a preliminary classification of light and heavy materials before the materials are deposited in the drum. This is accomplished by fluidizing the materials during their transit through the conduit 32 housing the screw 14. Referring to FIG. 6, the screw 14 includes a spiral blade 94 fixed around the outer surface of a hollow shaft 96 which has its end within the drum 16 closed. Within the shaft 96 is freely positioned a tube or pipe 98 which has one end closed adjacent the end of the shaft and its other end extending outside the hopper 10 and connected to a suitable source 100 of air to be forced under high pressure, such as about one hundred pounds psi, into the pipe 98. The pipe 98 is apertured as at 102 throughout its length within the shaft 96 and the shaft is likewise apertured at intervals throughout its length as at 104. thus, the air under pressure escapes to the materials being propelled by the screw 14 toward the drum 16.

The pipe 98 is supported by any suitable means within the shaft 96 as by bearings 103 which permit the pipe to remain stationary while the shaft rotates. It has been found that such fluidizing of the materials within the conduit 32 as they are being transported to the drum performs a preliminary air classification by lifting a substantial amount of the light materials into the upper portion of the conduit while the heavy materials gather in the bottom portion thereof. Thus, the light materials, being already partially separated, are more easily classified within the rotary drum.

From the foregoing it will be apparent that all of the objectives and advantages of this invention have been achieved by the apparatus shown and described which provides means for performing a preliminary air classification of materials, which provides control of the lights-to-heavies ratio within the drum, by utilization of a screw feed housed within a cylindrical conduit which prevents interception by the conveyor of heavy materials within the drum, and by adjustment of the screw feed mechanism so as to selectively locate the point of materials deposited within the drum.

It is to be understood, however, that various modifications and changes in the apparatus shown and described may be made by those skilled in the art without departing from the spirit of the invention as expressed in the accompanying claims. Therefore, all matter shown and described is to be interpreted as illustrative and not in a limiting sense.

What is claimed is:

1. A rotary drum classifier means for separating materials comprising a base, an open-ended drum mounted on said base for rotation about its axis, a hopper mounted on said base in spaced relation to one end of the drum and adapted to receive mixed materials to be separated, conveying means having one end attached to said hopper and the other end disposed within the drum for transporting materials from the hopper into the drum, and means for moving said conveying means longitudinally of the drum for adjusting the position of the end of the conveying means within the drum.

2. A means for separating as set forth in claim 1 wherein said conveying means is a screw feed device.

3. A means for separating as set forth in claim 2 wherein said screw feed device comprises a tubular conduit extending from the hopper into the drum, and screw means within the conduit for driving materials from the hopper through the conduit into the drum.

4. A rotary drum classifier means for separating materials comprising a support, an open-ended drum mounted for rotation about its axis, a hopper mounted on said support in spaced relation to one end of the drum, conveying means supported at one end by said hopper and having its other end extending into said drum, and means for moving said hopper on said support and for consequently adjusting said other end of the conveyor means longitudinally within the drum.

5. A means for separating as set forth in claim 4 wherein said conveying means is a screw feed device.

6. A means for separating as set forth in claim 5 wherein said screw feed device comprises a tubular conduit extending from the hopper into the drum, and screw means within the conduit for driving materials from the hopper through the conduit into the drum.

7. A means for separating as set forth in claim 4 wherein said other end of the conveying means is disposed coaxially with said drum.

8. A means for separating as set forth in claim 4 wherein said other end of the conveying means is disposed above the axis of said drum.

9. A rotary drum classifier means for separating materials comprising a support, an open-ended drum mounted on said support for rotation about its axis, a hopper mounted on said support in spaced relation to one end of the drum, conveying means supported at one end by said hopper and having its other end extending into said drum, and adjusting means for moving said hopper on said support and for consequently adjusting said other end of the conveying means longitudinally within the drum, said adjusting means comprising support means fixed on said hopper and movably positioned on said support, and drive means connected with said support means for moving said support means, hopper and conveying means in a direction toward or away from the drum.

10. A means for separating as set forth in claim 9 wherein said support comprises a pair of spaced longitudinally extending members having track portions thereon, said support means comprises a pair of spaced rails disposed parallel with said members, and roller means carried by said rails and disposed for movement along said track portions, and said drive means comprises a drive shaft, a drive gear on one end of the drive shaft, a racklike member fixed to said hopper and meshing with the drive gear, and operating means connected to said drive shaft for rotating the drive shaft and drive gear to propel the hopper along said support.

11. A means for separating as set forth in claim 10 wherein said operating means is a motor.

12. A means for separating as set forth in claim 10 wherein said members are channel irons having their open sides facing one another, and said rails are positioned between said channel irons with the roller means disposed within the channel irons and residing upon the lower sides thereof.

* * * * *